United States Patent [19]

Cinelli

[11] 4,097,760

[45] Jun. 27, 1978

[54] X-RAY TUBE HAVING BEARING LUBRICATION

[75] Inventor: Gabriel Cinelli, Niles, Ill.

[73] Assignee: Picker Corporation, Cleveland, Ohio

[21] Appl. No.: 707,219

[22] Filed: Jul. 21, 1976

[51] Int. Cl.[2] ..... H01J 35/04

[52] U.S. Cl. ..... 313/60; 29/148.4 B; 29/148.4 L; 308/240; 308/241; 308/DIG. 8; 308/DIG. 9

[58] Field of Search ..... 313/60; 308/DIG. 8, 308/DIG. 9, 240, 241; 29/148.4 B, 148.4 L

[56] References Cited

U.S. PATENT DOCUMENTS 3,720,853 3/1973 Atlee et al. ..... 313/60

*Primary Examiner*—Rudolph V. Rolinec
*Assistant Examiner*—Darwin R. Hostetter
*Attorney, Agent, or Firm*—Watts, Hoffmann, Fisher & Heinke Co.

[57] ABSTRACT

An X-ray tube comprises a rotatable anode supported by a bearing structure having portions lubricated by lead. The bearing structure includes a grooved outer race which is coated with ion-implanted lead, an inner race comprising a grooved portion of a spindle, and a plurality of lead-burnished balls disposed between the races.

6 Claims, 3 Drawing Figures

X-RAY TUBE HAVING BEARING LUBRICATION

CROSS-REFERENCE TO RELATED APPLICATION

"X-Ray Tube", Ser. No. 707,218, filed July 21, 1976 by Avery D. Furbee et al.

BACKGROUND OF THE INVENTION

1. Field of the Invention

The invention relates to X-ray tubes having rotating anodes and, more particularly, to means for lubricating anode support bearings to greatly extend their life.

2. Description of the Prior Art

Conventional medical diagnostic X-ray tubes are comprised of an evacuated glass envelope which surrounds a cathode and an annular, rotatable anode. When a sufficient electrical potential has been established between the cathode and the anode, electrons flow from the cathode and impinge upon the anode, causing the anode to generate X-rays. For this to occur, the anode must absorb large amounts of energy and considerable heat is generated. The heat has a deleterious effect on the entire X-ray tube.

X-ray tubes typically have a life of only about 50 operating hours and the relatively short operating life often is due to bearing failure. The bearing failure frequently is occasioned by the extremely adverse conditions existing within the X-ray tube. Temperatures are known to reach 950° C at the anode and up to 400° C in the anode support structure; vacuums are drawn to approximately $10^{-3}$ to $10^{-6}$ Torr. Lubrication under these conditions is a significant problem. Organic lubricants normally used in everyday cases will not work because the vapor pressure of the lubricants is so low that in a vacuum they volatize quite readily. Moreover, the temperature within the X-ray tube is completely unacceptable to an organic lubricant.

Attempts have been made to extend the life of X-ray tubes by providing improved bearing structures. An example is the patent to Atlee et al., U.S. Pat. No. 3,720,853, wherein the rotating anode is supported by a refractory carbide ball-bearing structure. Although improvements in bearing life have been achieved, the life of an X-ray tube still is short.

SUMMARY OF THE INVENTION

The present invention provides an X-ray tube having a rotatable anode with a bearing structure which is extremely reliable and long-lived. The invention includes a rotor body having a copper bearing housing concentrically disposed therein. A steel spindle is concentrically and rotatably supported within the housing by a bearing structure and is rigidly affixed to the rotor body to support the rotor body for rotation.

The invention includes new and improved bearing lubrication through a thin-film, solid lubricant in the form of uniquely applied lead. In its most favorable form, the bearing structure includes a solid, grooved outer race having implanted lead, an inner race comprising a grooved portion of the spindle, and a plurality of lead-burnished balls disposed between the races.

DESCRIPTION OF THE PREFERRED EMBODIMENT

Figure 1:
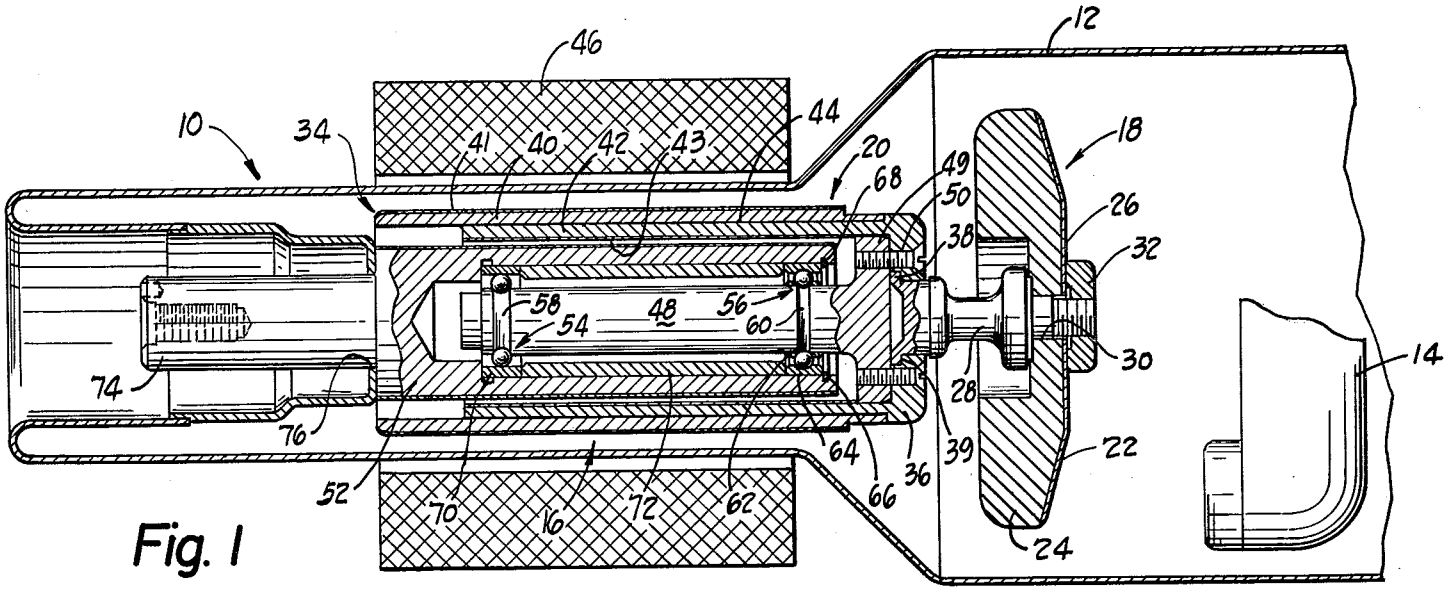
FIG. 1 is a cross-sectional view of an X-ray tube according to the invention and illustrating a preferred bearing structure.

FIG. 1 shows an X-ray tube 10 comprising an evacuated envelope 12 drawn to a vacuum of about $10^{-3}$ to $10^{-6}$Torr. A cathode 14 and a rotatable anode assembly generally designated at 16 are disposed within the envelope. The parts thus described operate in a conventional manner to direct electrons from the cathode to the anode where impingement of the electrons causes X-rays to be generated.

The anode assembly 16 includes an anode 18 which rotates in use at speeds up to about 10,000 r.p.m. The anode 18 is carried by a support structure 20. The anode 18 has a frustoconical target area 22. The target area has an apex angle selected to produce a focal spot of a desired apparent size. The anode 18 is comprised of a substance capable of generating X-rays and yet sustaining the high temperatures created by the impinging electrons, which temperatures may reach 950° C. An advantageous material has been found to be a base structure 24 of molybdenum coated with a thin layer 26 of rhenium-tungsten. The anode 18 is supported by a shaft 28 which extends through an opening 30 in the anode 18 and which is rigidly affixed to the anode 18 by a threaded fastener 32. The anode support structure 20 includes a generally-cylindrical rotor body 34 closed at one end as at 36. The shaft 28 extends outwardly of the end portion 36 and is retained by an annular flange 38 which engages a recess 39. The rotor body also includes an outer, cylindrical sleeve 40 and an inner, cylindrical sleeve 42. The sleeves are adapted to mate snugly and are rigidly affixed to each other as by brazing indicated at 44.

The support structure 20 is part of an induction motor employed to rotate the anode 18. A coil 46 surrounds the envelope 12 and generates a magnetic field which operates in a well-known manner to rotate the anode 18. The outer sleeve 40 is made of copper and serves as the armature to efficiently develop torque. The inner sleeve 42 is made of steel and closes the magnetic path generated by the coil 46 to assist the copper sleeve 40 in developing torque. The structural integrity and heat transfer characteristics of the support structure 20 are enhanced because end portion 36 is integral with the inner sleeve 42.

The support structure 20 also includes a steel spindle 48 having a base 49 concentrically disposed within the rotor body 34. The spindle 48 is rigidly affixed to the end portion 36 by threaded fasteners 50 which engage the base 49. When fully tightened by the fasteners 50, the base 49 of the spindle 48 engages the flange 38 to securely affix the shaft 28 to the end portion 36.

A cylindrical, copper bearing housing 52 is disposed concentrically within the rotor body 34 and about the spindle 48. The bearing housing 52 includes spaced bearings 54, 56. In the embodiment shown in FIG. 1, the spindle 48 is grooved at 58, 60 to provide inner races for the bearings 54, 56, respectively. Because the bearing 56 is close to the high-temperature, relatively heavy anode 18, the bearing 56 is subjected to higher temperatures and higher loads than the bearing 54. Accordingly, the bearing 56 desirably is more ruggedly constructed and includes split inner ball supports 62 and a grooved, one-piece outer race 64. The bearing 56 is retained within the bearing housing 52 by a retaining ring 66 which engages a circumferential groove 68 in the inner, forward portion of the bearing housing 52. The bearing 54 comprises a one-piece, non-grooved outer race 70. The outer races 64, 70 are spaced by a tubular member 72 concentrically disposed within the bearing housing 52 and in tight engagement therewith. By this construction, effective heat transfer occurs through the bearing housing 52 from each of the bearing outer races.

The lubrication of the bearings 54, 56 represents a special and difficult problem. It is anticipated that bearings 54, 56 will have radial and axial tolerances between the balls and races on the order of tens of millionths of an inch. Thus, in order not to affect the tolerance designs of these bearing systems, any solid lubricants used must be of a thin-film type and applied to a thickness of approximately 10,000 angstroms or less.

Most advantageously, the lubricant comprises lead which is ion-implanted to the outer race 64. Ion implanting, or ion-plating as it is sometimes called, is a technique well-known to those skilled in the art and need not be described further. Lead also is applied to other portions of the bearings, particularly the balls, by burnishing. Ion implanting of lead to all bearing parts produces effective results, but greatly enhanced bearing life is had even if only the outer race is implanted with lead. Although applicant does not wish to be bound by a particular theory of operation, it is thought that a mechanical transfer of lead from outer race to balls occurs during rotation of the anode 18. This transfer maintains the thin coat initially applied to the balls by burnishing. Hence, implanting lead only to the outer race provides acceptable results. Tests have established that other ion-implanted materials also produce improved bearing life. It has been found that soft metals such as gold and silver; metal/nonmetallic compounds such as molybdenum disulfide or niobium disalinide; and intermetallic compounds such as gold-silver or silver-copper, among others, are effective.

The outer race 64 was selected for the implantation of lead because it is the coolest portion of the bearings 54, 56. This is because the bearing housing 52 includes an extended portion 74 which passes through an opening 76 in the envelope 12. The interface between the bearing housing 52 and the envelope 12 in the region of the opening 76 must be sufficiently tight to insure that a vacuum is maintained within envelope 12. The extended portion 74, however, permits heat to be conducted rapidly from the interior of the envelope 12. Techniques for this are well-known in the art and it is common to circulate a coolant fluid such as oil in heat exchange relationship with the extended portion 74. It will be apparent that the bearing housing 52 will be one of the cooler portions of the support structure 20 and that the spindle 48 will be one of the hotter portions of the support structure 20 because of its engagement with the shaft 28. The lubricant, therefore, is implanted to the outer race 64 because it is in contact with the bearing housing 52 and therefore is the coolest portion of the bearing structure and will have the least tendency to vaporize the lubricant implanted. It is possible, of course, for the parts to be reversed. In this event, the rotor body 34 would be in contact with the outer race 64 and the spindle 48 or its equivalent would extend outwardly of the envelope 12. Hence, the inner race 62 would be the coolest and lead would be implanted to the inner race. Regardless of the construction of the support structure 20, the lubricant preferably will be implanted to that portion of the bearing structure which can be maintained at the lowest temperature.

Figure 2:
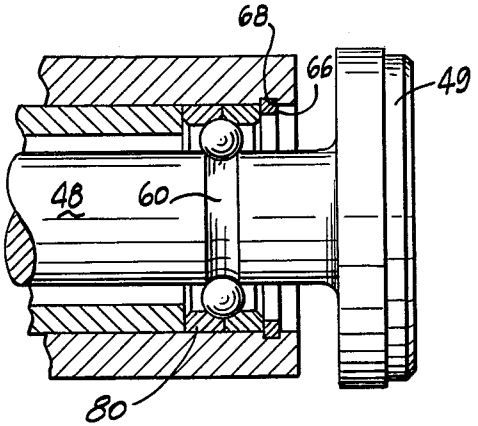
FIG. 2 is a fragmentary detailed cross-sectional view of a portion of the X-ray tube of FIG. 1 illustrating an alternative bearing structure.
Figure 3:
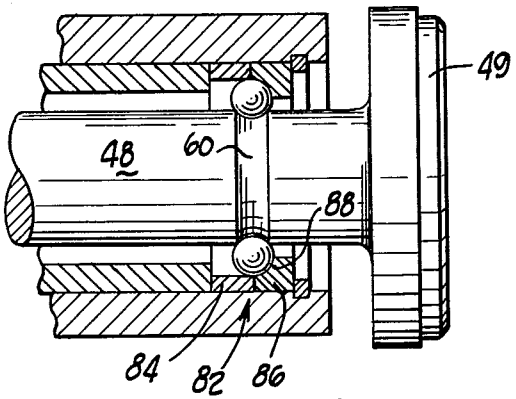
FIG. 3 is a fragmentary detailed cross-sectional view of an X-ray tube similar to FIG. 1 and illustrating an alternative bearing structure.

Alternative bearing arrangements are illustrated in FIGS. 2 and 3. In FIG. 2, the split inner ball supports 62 are not used and the balls are supported entirely within the groove 60. To permit assembly of the bearing, outer race 80 is split. In all other respects, the invention is the same as that illustrated in FIG. 1. The embodiment illustrated in FIG. 3 provides greater thrust-loading capability. No inner race is employed and outer race 82 is split. The outer race 82 includes a ring 84 having no indentations and a ring 86 having an arcuate portion 88 adapted to engage the balls to prevent axial movement of the spindle 48. In all other respects, the embodiment illustrated in FIG. 3 is identical to that illustrated in FIG. 1.

Although the invention has been described with a certain degree of particularity, it is understood that the present disclosure of the preferred embodiment has been made only by way of example. Numerous changes in the details of construction of the X-ray tube and in its support structure may be resorted to without departing from the true spirt and scope of the invention.

What is claimed is:

1. An X-ray tube, comprising:

(a) an evacuated envelope;

(b) a cathode and an anode disposed within said envelope;

(c) means supporting said anode for rotation, said means including a bearing having portions lubricated by the ion implantation of a thin layer of metal.

2. The X-ray tube of claim 1, wherein said metal is lead.

3. The X-ray tube of claim 1, wherein said bearing includes an outer race, an inner race, and a plurality of rolling members disposed therebetween, at least the coolest portion of said bearing having lead implanted thereon.

4. The X-ray tube of claim 3, wherein said outer race is lead-implanted.

5. The X-ray tube of claim 4, wherein said rolling members are balls and said balls are lead-burnished.

6. The X-ray tube of claim 5, wherein said inner race comprises a groove in said spindle, said groove not being coated with lead.

* * * * *

UNITED STATES PATENT AND TRADEMARK OFFICE

CERTIFICATE OF CORRECTION

PATENT NO. : 4,097,760

DATED : June 27, 1978

INVENTOR(S) : Avery D. Furbee and Gabriel Cinelli

It is certified that error appears in the above-identified patent and that said Letters Patent are hereby corrected as shown below:

After Title, change "Inventor" to -- Inventors --, and after "Inventors:", add -- Avery D. Furbee, Elmhurst, Ill. --;

Signed and Sealed this

*Sixth* Day of *February 1979*

[SEAL]

*Attest:*

RUTH C. MASON
*Attesting Officer*

DONALD W. BANNER
*Commissioner of Patents and Trademarks*